US007837045B2

(12) United States Patent
Seitzberger et al.

(10) Patent No.: US 7,837,045 B2
(45) Date of Patent: Nov. 23, 2010

(54) RAIL VEHICLE WITH COUPLING CONNECTION ADAPTED FOR CRASH

(75) Inventors: Markus Seitzberger, Vienna (AT); Thomas Platter, Vienna (AT); Wilhelm Mayer, Vienna (AT)

(73) Assignee: Siemens Aktiengesellschaft Osterreich, Vienna (AT)

( * ) Notice: Subject to any disclaimer, the term of this patent is extended or adjusted under 35 U.S.C. 154(b) by 82 days.

(21) Appl. No.: 11/909,933

(22) PCT Filed: Apr. 4, 2006

(86) PCT No.: PCT/AT2006/000135

§ 371 (c)(1),
(2), (4) Date: Sep. 27, 2007

(87) PCT Pub. No.: WO2006/105566

PCT Pub. Date: Oct. 12, 2006

(65) Prior Publication Data

US 2008/0156762 A1 Jul. 3, 2008

(30) Foreign Application Priority Data

Apr. 4, 2005 (AT) ..... A 570/2005

(51) Int. Cl.
*B61G 11/16* (2006.01)

(52) U.S. Cl. ..... 213/9; 213/50; 213/62 R

(58) Field of Classification Search ..... 213/9, 213/50, 51, 56, 58, 60, 61, 62 R
See application file for complete search history.

(56) References Cited

U.S. PATENT DOCUMENTS 594,891 A * 12/1897 McKeen ..... 213/9
3,197,039 A 7/1965 Herbert
4,184,434 A 1/1980 Chapin
4,736,688 A 4/1988 Ando et al.
5,579,699 A 12/1996 Dannawi et al.

(Continued)

FOREIGN PATENT DOCUMENTS

CA 02577993 AA 3/2006

(Continued)

OTHER PUBLICATIONS

Mueller F.,"Herstellung Von Schienenfahrzeugen" Zeitschrift Fur Eisenbahnwesen Und Verkehrstechnik. Die Eisenbahntechnick + Glasers Annalen, George Siemens Verlagsbuchhandlung. Berlin de, vol. 123. No. 1, Jan. 1999, pp. 9-15, XP000791834 ISSN: 0941-0589.

(Continued)

*Primary Examiner*—S. Joseph Morano
*Assistant Examiner*—Zachary Kuhfuss
(74) *Attorney, Agent, or Firm*—Sutherland Asbill & Brennan

(57) ABSTRACT

A rail vehicle having a vehicle body (WKA) comprising on at least one vehicle end a compression zone (STA) located behind an end carrier (ETR) of the vehicle body, and having a central buffer coupling (KUP) extending from a substantially vertical pivot axis (SWA) to the vehicle end and connected to said vehicle body via a coupling carriage (KSL) wherein said coupling carriage (KSL) is attached to said end carrier (ETR) and extending from said end carrier (ETR), bridging said compression zone (STA), towards the vehicle center, and which is guided longitudinally slidable on the vehicle body (WKA).

10 Claims, 8 Drawing Sheets

U.S. PATENT DOCUMENTS

| | | | | |
|---|---|---|---|---|
| 5,715,757 | A * | 2/1998 | Dannawi et al. | 105/392.5 |
| 5,826,462 | A * | 10/1998 | Schaefer | 74/473.37 |
| 6,688,237 | B2 | 2/2004 | Back et al. | |
| 6,832,669 | B2 | 12/2004 | Schobergegger et al. | |
| 6,834,909 | B1 | 12/2004 | Malfent et al. | |
| 2007/0131135 | A1 | 6/2007 | Moser et al. | |
| 2007/0214996 | A1 | 9/2007 | Nedelik | |

FOREIGN PATENT DOCUMENTS

| | | | |
|---|---|---|---|
| DE | 1279709 | B | 10/1968 |
| DE | 4332289 | A1 | 3/1995 |
| FR | 2698840 | | 6/1994 |
| FR | 2775240 | A1 | 8/1999 |
| FR | 2789038 | | 8/2000 |

OTHER PUBLICATIONS

International Search Report of the International Searching Authority, PCT/AT2006/000135.

* cited by examiner

-- PRIOR ART --

RAIL VEHICLE WITH COUPLING CONNECTION ADAPTED FOR CRASH

This is the National Stage of International Application No. PCT/AT2006/000135, filed Apr. 4, 2006, which claims benefit of Austrian Patent Application No. A 570/2005, filed Apr. 4, 2005. These applications are incorporated herein by reference.

The invention relates to a rail vehicle having a vehicle body comprising on at least one vehicle end a compression zone located behind an end carrier and having a (central buffer) coupling protruding from a substantially vertical pivot axis beyond the vehicle end, and connected to carrier of the vehicle body.

In rail vehicles of the representational type in case of frontal collision first there will be an abutment of the couplings. Usually the couplings contain shock absorbing and/or resilient members receiving at least a part the impact energy under shortening in longitudinal direction. If the lowering of energy in the coupling is not sufficient which is the case in higher speed collisions between vehicles, the compression zone present on each car located behind each end carrier subsequently has to receive the remainder of the impact energy and to prevent or limit damage on the remaining part of the vehicle and thus to protect people. Before engaging of the end sides of the vehicles, generally the respective anti-climbing protective devices, it is mostly intended to separate the coupling via a designed shear position from the vehicle body to avoid that the collision force is introduced via parallel load paths (coupling and compression zone of the vehicle body) into the vehicle bodies and that unacceptable high total forces occur in the vehicle bodies. Besides of the previously mentioned damages on the vehicles this would also lead to increased retardations of the vehicles and thus to an increased risk of injury for people.

The solution for prior art train vehicles comprising a central buffer coupling and compression zone arranged right behind the end carrier described in the introduction is schematically represented in FIG. 1*a* through 1*c*. The vehicle body 10 of a not further shown rail vehicle holds on its ends an end carrier 12 running transversely to the direction of travel and terminating in an anti-climbing protection device 14. Such an arrangement is well known and arises, for example, in PCT Patent Application Publication No. WO 2004/110 842 A1. Towards the vehicle center is a compression zone 16, which in the case of a collision may deform in a controlled way. On a bearing block 18 of the central longitudinal beam 20 (or on a coupling cross beam, a perpendicular coupling mounting plate, etc.) the coupling 22 is pivotable about a substantially vertical pivot axis 24 and is attached by means of shear bolts 26. It terminates in a coupling end piece 28 that is connectable with a same end piece of an adjacent vehicle. In the shown example, the coupling arm 30 is telescopic. When in the case of a collision the acting force exceeds a certain amount, a deformation member 32 may be used, as indicated. In most of the cases, however, the coupling arm 30 contains shock absorbing and/or resilient members, as can be seen, for example, in U.S. Pat. No. 3,149,731 A.

F*igure* 1*b* shows a first phase of a collision in which the force acting on the coupling end piece has become so large that the deformation member 32 has reacted and the coupling arm 30 has been pushed together. In this phase, the anti-climbing protection devices 14 of the colliding vehicles start to engage each other and the introduction of force has to take place via the anti-climbing protection device so that the action of the compression zone may begin. To permit this, the bolts 26 shear off and via the coupling 24—as desired —no more introduction of force is possible, as shown in FIG. 1*c*. Thus, the total force on the vehicle body is defined by the deformation taking place in the compression zone of the compression members provided there.

However, the shearing off of the coupling involves the risk of derailments since the coupling can get caught with the track bed, can collide with the bogie etc. It is possible to reduce this danger by special devices such as guide bars, retaining chains etc., but this generally requires that the coupling may shear off before the vehicle bodies engage each other, but this is not possible in all implementations and design requirements, respectively.

An objective of the invention is the creation of a coupling connection for a rail vehicle in which a shearing off of the coupling is not necessary to avoid in the case of collision unwanted parallel load paths, namely on the one hand the coupling and on the other hand the compression zone. Thus retardations in the region of passengers are to be limited and the stability of this region has to be ensured. Moreover the problems that may arise from a sheared off coupling are supposed to be cancelled.

According to the invention this objective is solved by a rail vehicle of the above mentioned type in that to the end carrier a coupling carriage is attached which is extending from the end carrier, bridging the compression zone, towards the vehicle centre, and which is guided longitudinally slidable on the vehicle body.

FIG. 2*a* through 2*c* show in a similar view like FIG. 1 but for two vehicles coupled to each other the invention in a simplified and schematic representation. In these figures for the same parts the same reference numerals are used as in FIG. 1*a* through 1*c*.

As can be seen, the coupling 22 according to the invention is fixed to the lower side of a coupling carriage 34, and here —in contrast to the prior art —no shear bolts or the like are in use. The coupling carriage 34 is attached to an end carrier 12 of the vehicle body 10, and runs from here, bridging the compression zone 16, toward the vehicle center. It is supported longitudinally slidable behind the compression zone 16 on a central longitudinal beam 20 of the vehicle body 10, as will be explained in more detail below.

In contrast to a conventional coupling connection in which the coupling longitudinal forces are directly introduced into the vehicle body 10 behind the compression zone 16, according to the invention, these are introduced via the coupling carriage 34, the end carrier 12, and the compression zone 16 into the vehicle body 10.

In the case of a collision, the two adjacent vehicles are pushed against one another, and the coupling arms 30 first are telescopically pushed together with the overcoming of the deformation members 32, until in the second phase of the collision when the anti-climbing protection devices 14 of both vehicles engage each other, as shown in FIG. 2*b*. It is to be emphasized here that the coupling arms also can be formed according to other known constructions and may include, for example, integrated attenuation members.

With a continuing force effect a deformation of the compression zone will occur, as can be seen in FIG. 2*c*, and during this deformation the coupling carriage 34 will be displaced along the central longitudinal beam 20 toward the vehicle center. It is clear that in this way a shearing off of the coupling is not required, and also the problems explained above with such a shearing off can not appear. Since all longitudinal forces are introduced via the end carrier, regardless whether or not the coupling continues to transmit forces, the total force on the vehicle body is always limited by the maximum compression force in the compression zone.

In an aspect, practical concerning the introduction of force, it is provided that the coupling carriage is guided on a central longitudinal beam of the vehicle body.

For the purpose of the invention it is also preferable when the coupling carriage is bolted to the end carrier and for the introduction of force there is provided a central bolt stub.

A guiding of the coupling carriage favourable in praxis is resulting when the coupling carriage comprises on its interior end two U-shaped guides protruding on both sides which comprise guiding webs located on the vehicle body.

A secured function of the invention, even after a long period of use, will be ensured if the coupling carriage is slidably supported on the vehicle body with the interposition of plastic insertions. Thereby e.g. it will be avoided to get rusty. But with the use of suitable plastics also the sliding friction forces can be minimized in a collision to ensure a longitudinal displacement with low force level.

The invention turns out to be very advantageous in a rail vehicle in which a coupling arm, running from an attachment location on the coupling carriage towards the end of the vehicle up to a coupling end piece, in the case of collision is able to be telescopically pushed together with the overcoming of a deformation member, or after the shearing off of an interior overload protection etc.

In the following the invention together with further advantages is explained in greater detail in FIGS. 1*a*-1*c* and FIGS. 2*a*-*c* and from an exemplary aspect which is illustrated in FIG. 3 through 7, in which FIGS. 1*a* through 1*c* are schematic cross-sectional views of a portion of a prior art rail vehicle, illustrating the rail vehicle in phases of a collision.

FIGS. 2*a* through 2*c* are schematic cross-sectional views of a portion of two rail vehicles of the present disclosure, illustrating the rail vehicles in phases of a collision.

FIGS. 3*a* and 3*b* are perspective views oblique from the bottom and from the front of the vehicle body of a rail vehicle according to the invention together with a coupling carriage in its original condition and in a deformed condition after a collision in a 3-D-crash simulation, respectively, and for a better visibility the actual coupling is not shown.

Figures 1A, 1B, 1C:
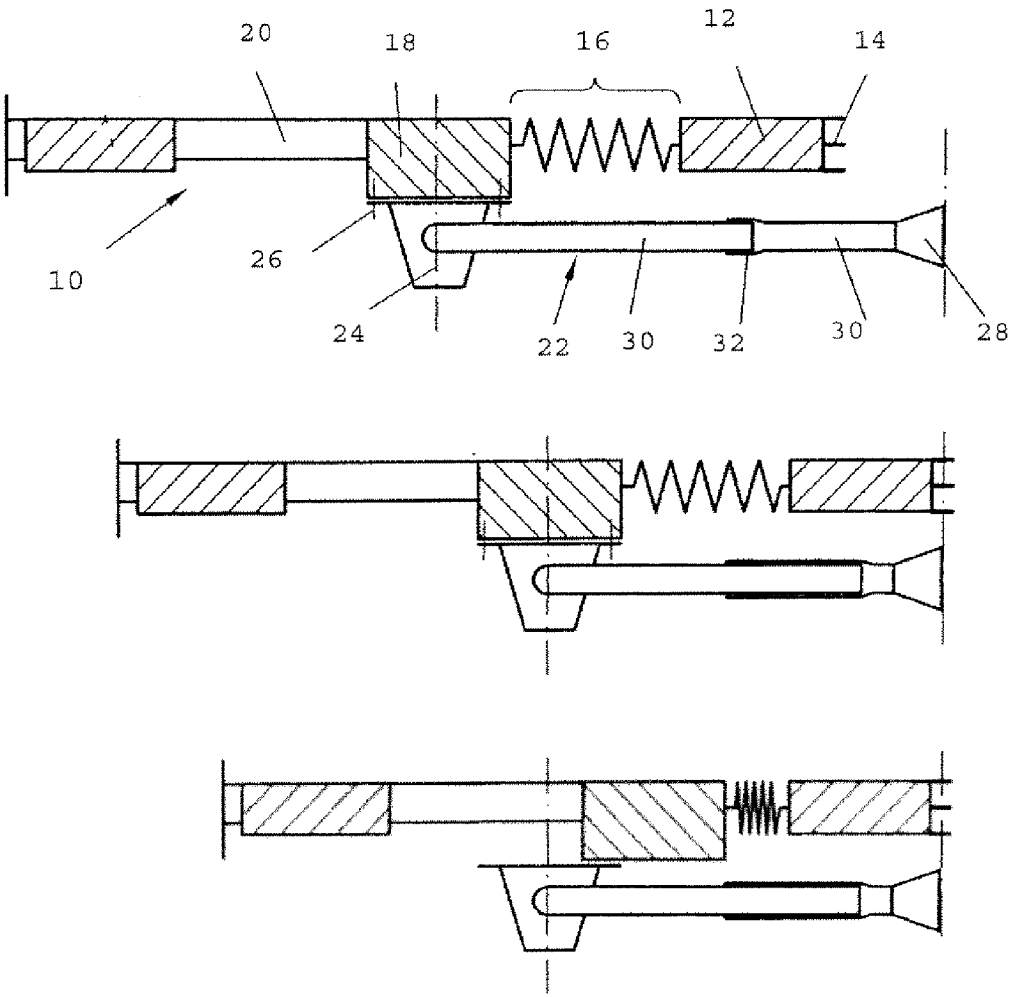
Figure 2A:
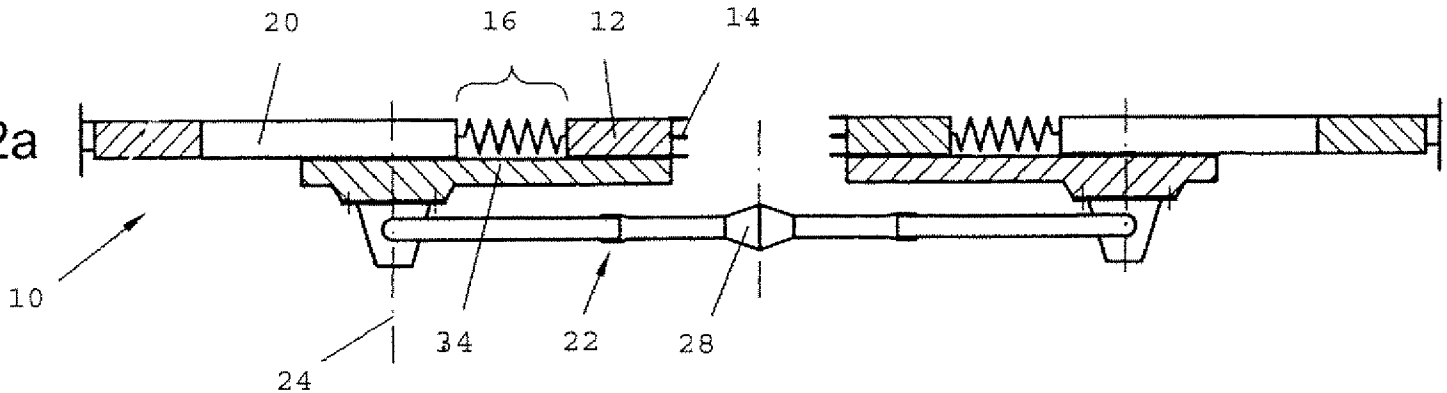
Figure 2B:
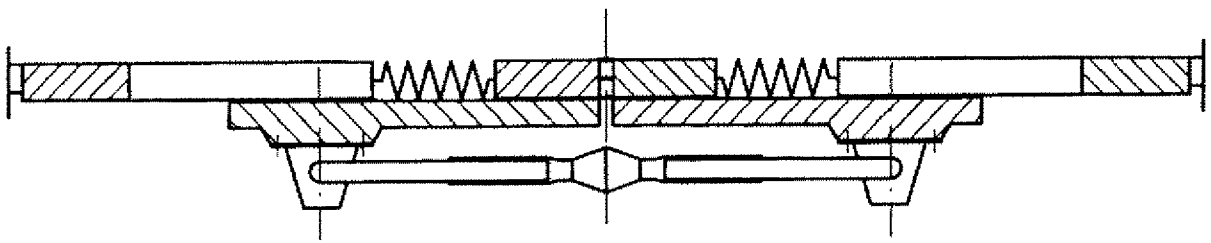
Figure 2C:
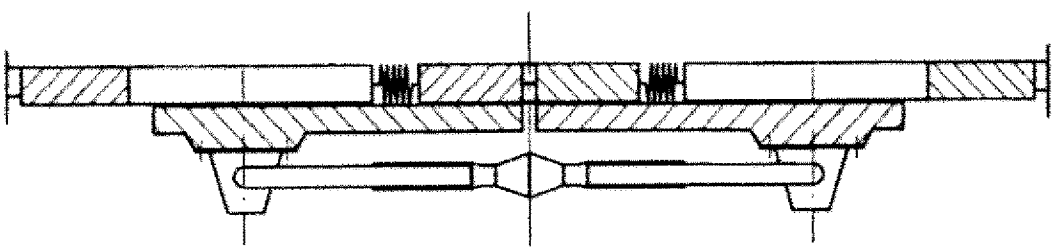
Figure 3A:
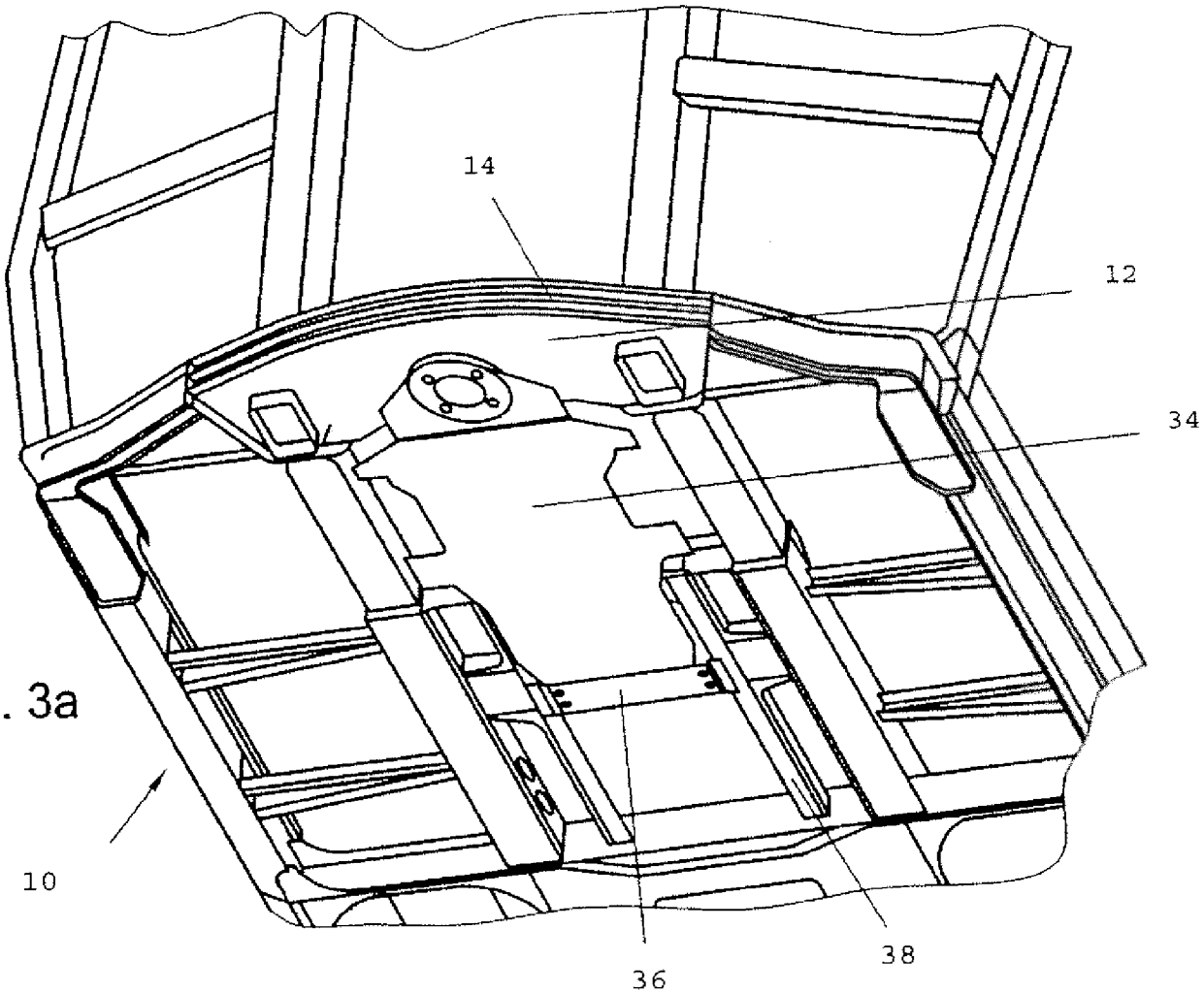
Figure 3B:
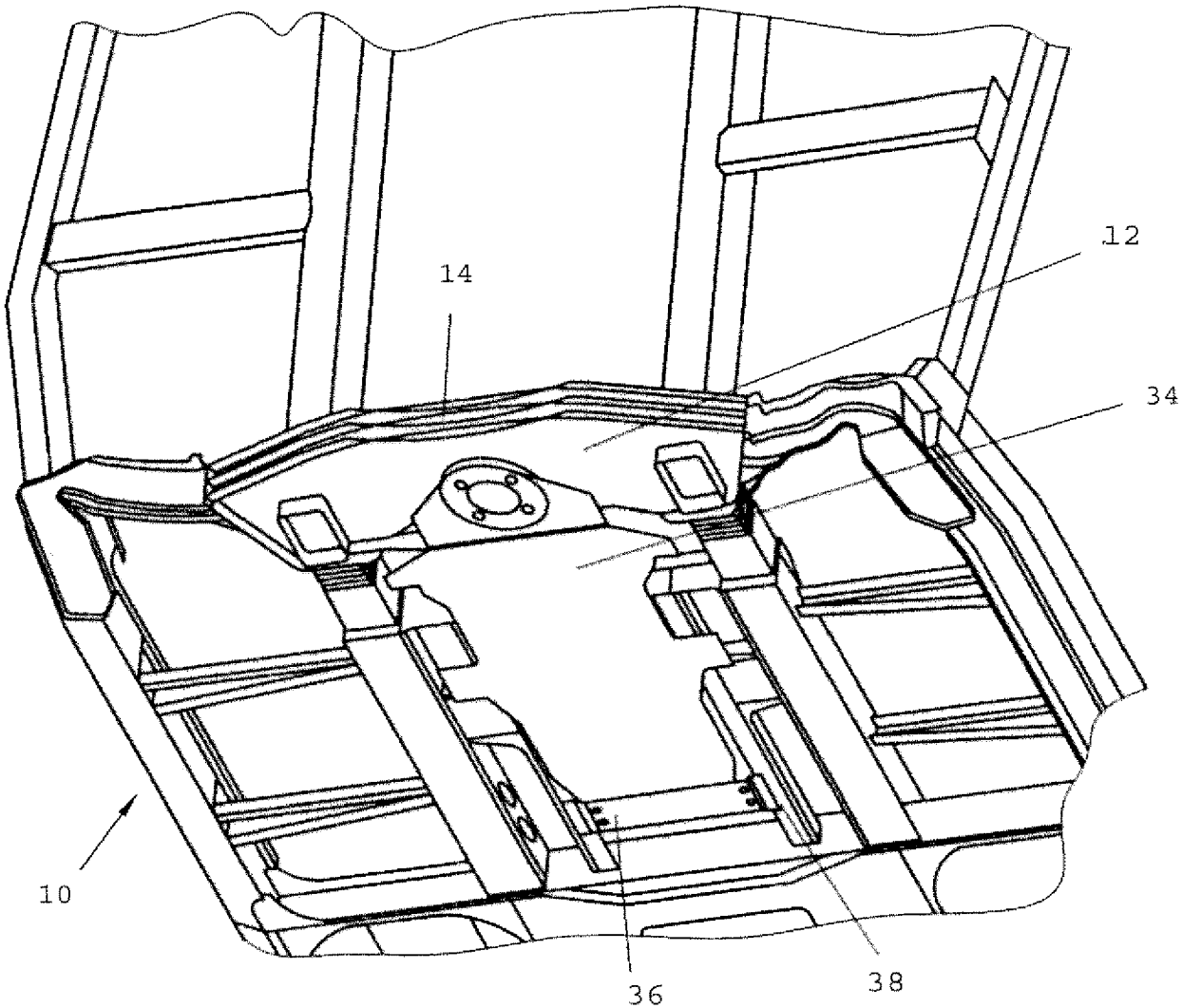

In FIGS. 3*a* and 3*b*, there is shown from a computer simulation of an actual aspect the crash performance of a rail vehicle according to the invention. FIG. 3*a* shows the condition of the end of a vehicle before a crash. It can be seen that the coupling carriage 34 is attached with one end to an end carrier 12 of the vehicle. Also coupled to this end carrier or integrally formed is the anti-climbing protection device 14. The coupling carriage 34 is extending toward the vehicle center and is guided on its other end by means of two U-shaped guides 36 protruding on both sides in that these comprise guiding webs 38 located on the vehicle 10. In FIGS. 3*a* and 3*b*, the actual coupling together with its coupling rod is omitted to be able to better show the coupling carriage in this oblique bottom view.

According to the illustration of FIG. 3*b*, following a collision the entire end carrier 12 is displaced toward the vehicle center, and the compression zone 16 is pushed together, accordingly. As can be seen, now the carriage 34 with its guides 36 has slipped along the guiding webs 38 toward the vehicle center.

Figure 4:
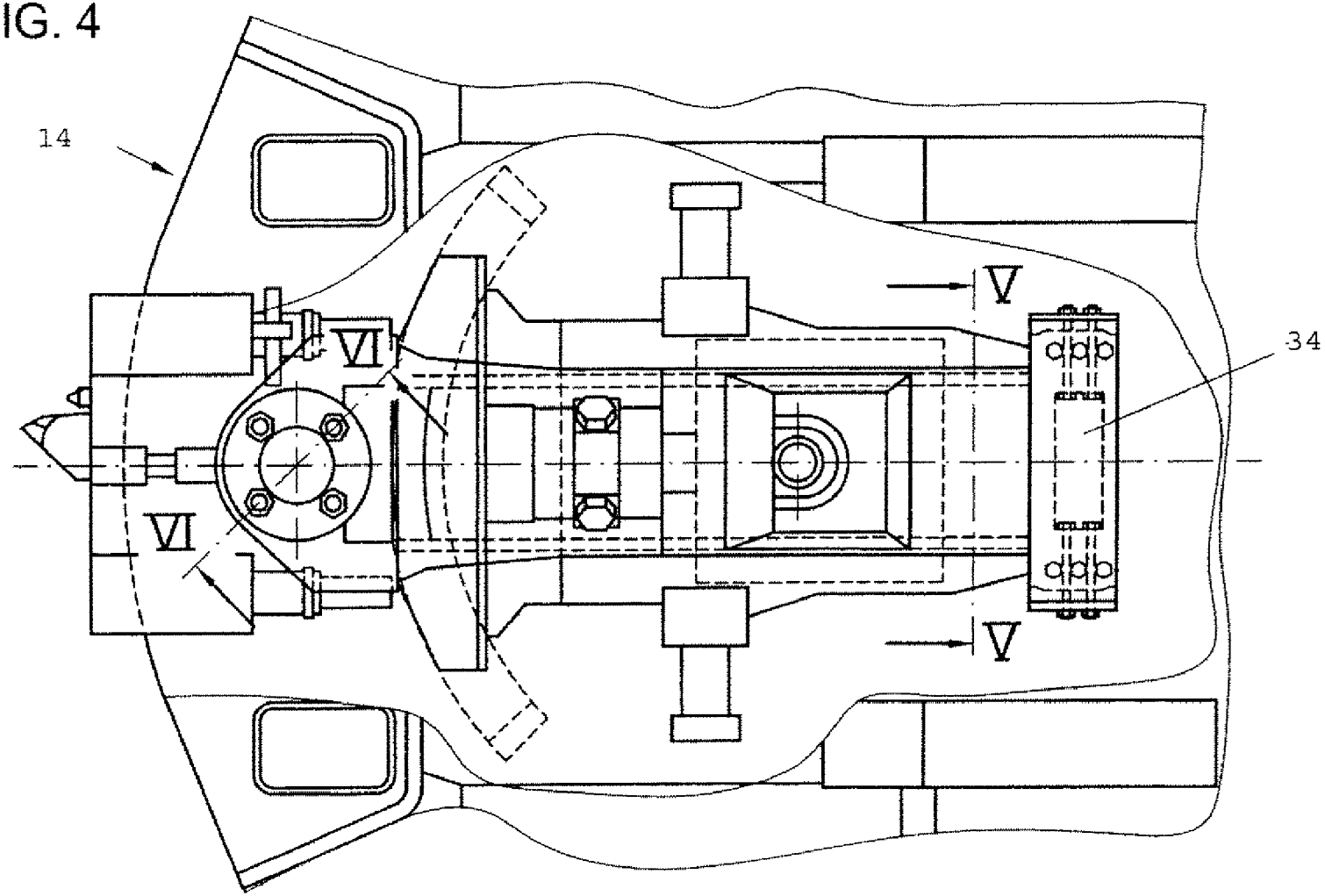
FIG. 4 is a plan view of a front portion of the vehicle body with coupling carriage and the coupling placed thereto.

FIGS. 4 through 7 show details of an actual embodiment. In FIG. 4—a plan view —on the left hand-side, one can see the outline of the anti-climbing protection device 14. The coupling is drawn in, as well.

Figure 5:
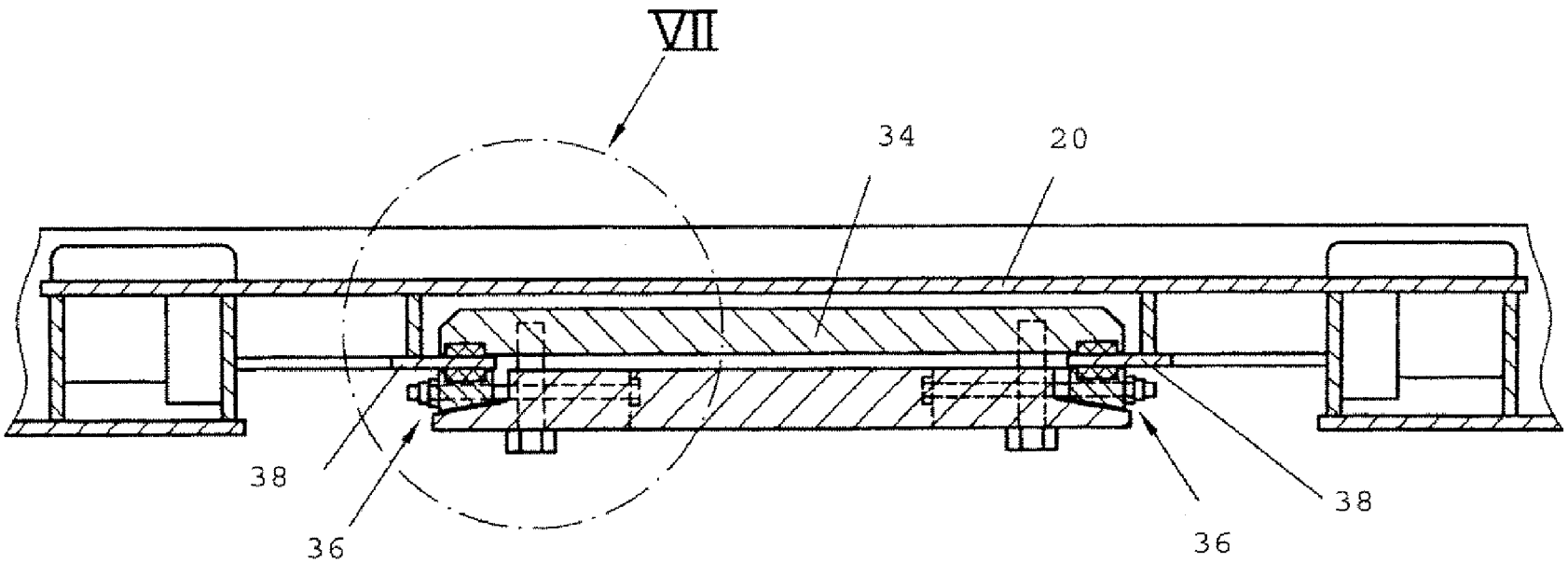
FIG. 5 is a sectional view of the line V-V of FIG. 4 in an enlarged representation.

FIG. 5 shows in enlarged representation the guide of the coupling carriage 34 on the central longitudinal beam 20 of the vehicle body. It can be seen that the coupling carriage 34 has on each of its left and right sides a U-shaped guide 36, and each guide 36 is encompassing an associated guiding web 38 connected to the central longitudinal beam. In a still enlarged view of FIG. 7, this can be recognised better. Each guide 36 has an upper leg 40 and a lower leg 42. Between the lower leg 42 and the guiding web 38 of the vehicle body, there is provided a wedge 44, adjustable in transverse direction, which is adjustable by means of a bolt and nut assembly such that the compression, with which the guide 36 is encompassing the web 38, can be adjusted. Further the guiding web 38 is encompassed with the interposition of plastic insertions 46, whereby for example a jam because of rust is to be avoided and the sliding friction forces between the guiding web 38 and the coupling carriage 34 can be minimized.

At this point it is to be mentioned that other ways of guiding the coupling carriage 34 on the vehicle body 10 can be useful. So it is possible to arrange a U-shaped guide on the vehicle body, and to arrange guiding webs on the coupling carriage 34 etc.

Figure 6:
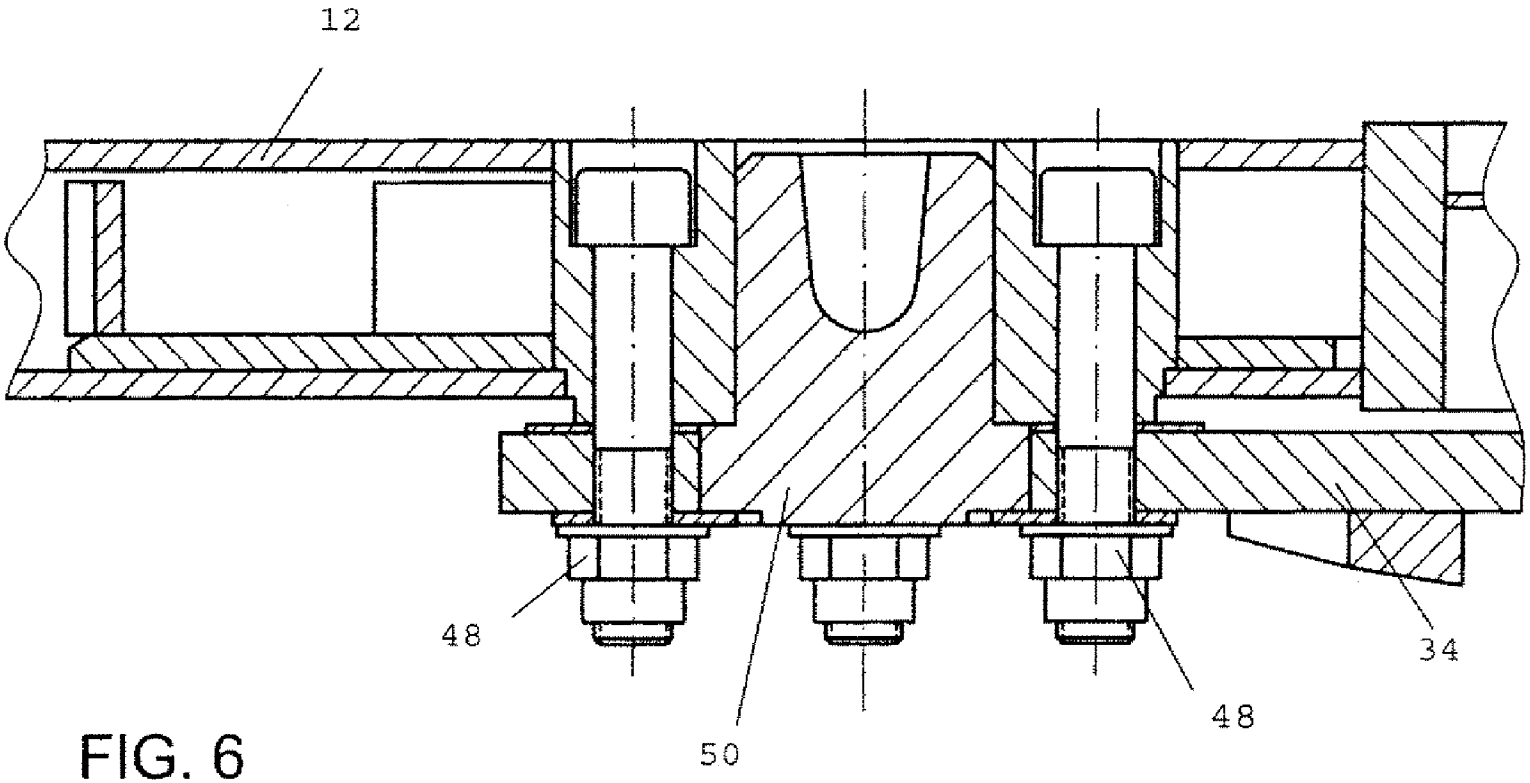
FIG. 6 is a sectional view of the line VI-VI of FIG. 4 also in an enlarged representation.
Figure 7:
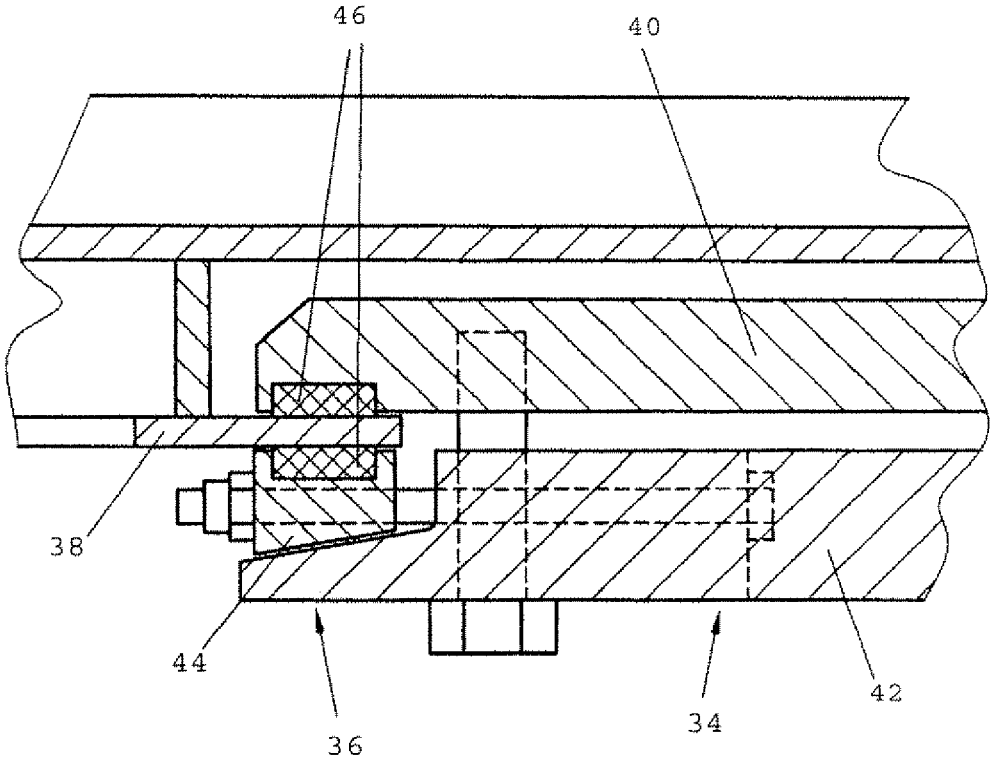
FIG. 7 is a detail VII of FIG. 5 in an enlarged representation.

Finally FIG. 6 shows that the coupling carriage 34 at the end carrier 12 is bolted by means of threaded bolts 48, and for defined and reliable introduction of force, a central bolt stub 50 is provided.

The invention claimed is:

1. A rail vehicle having a vehicle body comprising:

a compression zone on at least one vehicle end and located between said vehicle body and an end carrier of said vehicle body;

a coupling carriage fixedly attached to said end carrier, said coupling carriage extending from said end carrier, bridging said compression zone, towards the vehicle center, said coupling carriage capable of guided longitudinal movement on said vehicle body; and a central buffer coupling pivotably attached to said coupling carriage and connectable to another rail vehicle, wherein said coupling carriage includes on its interior end two U-shaped guides that are operably associated with guiding webs located on said vehicle body, said coupling carriage operable to longitudinally move said central buffer coupling with reference to said vehicle body in response to compression of said compression zone.

2. The rail vehicle of claim 1, wherein said coupling carriage is slidably supported at said vehicle body with the interposition of plastic insertions.

3. The rail vehicle of claim 1, wherein said central buffer coupling comprises a coupling arm, said coupling arm comprising a deformation member, said coupling arm operable to telescope in response to a collision, overcoming said deformation member.

4. A rail vehicle, comprising:

a compression zone located between a central body portion of the rail vehicle and an end portion of the rail vehicle;

a coupling carriage movably associated with the central body portion of the rail vehicle and fixedly attached to the end portion of the rail vehicle; and a coupling associated with the rail vehicle via the coupling carriage, the coupling comprising a pivot end pivotably attached to the coupling carriage and a free end connectable to another rail vehicle, the coupling carriage permitting translation of the pivot end of the coupling with reference to the central body portion of the rail vehicle in response to compression of the compression zone.

5. A rail vehicle of claim 4, wherein the coupling carriage is guided on a central longitudinal beam of the central body portion in response to compression of the compression zone.

6. A rail vehicle of claim 4, wherein the coupling carriage is bolted to the end portion, and a central bolt stub is provided for introduction of force.

7. A rail vehicle of claim 4, wherein the coupling carriage includes on its interior end two U-shaped guides protruding on both sides, the U-shaped guides operably associated with guiding webs located on the central body portion of the rail vehicle.

8. A rail vehicle of claim 7, wherein within at least one of said U-shaped guides an adjustable wedge is disposed and arranged such that one surface of the adjustable wedge is adjacent to the guiding web.

9. A rail vehicle of claim 4, wherein the coupling carriage is slidably supported at the central body portion with the interposition of plastic insertions.

10. A rail vehicle of claim 4, wherein the coupling comprises a coupling arm, the coupling arm comprising a deformation member, the coupling arm operable to telescope in response to a collision, overcoming the deformation member.

* * * * *